US005979843A

United States Patent [19]

Beck

[11] Patent Number: 5,979,843

[45] **Date of Patent: *Nov. 9, 1999**

[54] BABY BOTTLE HOLDER AND FEEDING DEVICE WITH ROLLING MEANS WHEN BABY DISENGAGES BOTTLE NIPPLE

[76] Inventor: Karen T. Beck, P.O. Box 96, Lake Forest, Ill. 60045

[ * ] Notice: This patent issued on a continued prosecution application filed under 37 CFR 1.53(d), and is subject to the twenty year patent term provisions of 35 U.S.C. 154(a)(2).

[21] Appl. No.: 08/908,443

[22] Filed: Aug. 7, 1997

[51] Int. Cl.[6] ..... A47D 15/00

[52] U.S. Cl. ..... 248/102; 248/105

[58] Field of Search ..... 248/102, 104, 248/105, 106; 215/395, 11.1

[56] References Cited

U.S. PATENT DOCUMENTS

| | | | |
|---|---|---|---|
| 2,134,746 | 11/1938 | Allen | 248/102 |
| 2,389,390 | 11/1945 | Silverman et al. | 215/11.1 |
| 2,711,052 | 6/1955 | Brayford . | |
| 4,405,106 | 9/1983 | Adler | 248/102 |
| 4,676,387 | 6/1987 | Stephenson et al. | 215/11 R |
| 4,726,551 | 2/1988 | Randall et al. | 248/105 |
| 4,809,938 | 3/1989 | Skinner et al. | 248/102 |
| 4,895,327 | 1/1990 | Malone et al. | 248/102 |
| 5,022,616 | 6/1991 | Kordecki | 248/106 |
| 5,072,843 | 12/1991 | James | 215/395 |
| 5,188,320 | 2/1993 | Polka | 248/103 |
| 5,582,335 | 12/1996 | Beard et al. | 248/102 |

*Primary Examiner*—Ramon O. Ramirez
*Attorney, Agent, or Firm*—Jenner & Block

[57] ABSTRACT

A baby bottle holder to be placed on the torso of an infant has means for tilting the bottle to enable the infant to feed therefrom and means for urging the baby bottle holder to roll off the infant's torso when the infant moves and disengages the nipple, e.g., because the infant has finished feeding. A weight is positioned in the baby bottle holder such that a moment is created that urges the roll off of the baby bottle holder. A pair of flaps stabilize the baby bottle holder while the infant is feeding.

17 Claims, 4 Drawing Sheets

BABY BOTTLE HOLDER AND FEEDING DEVICE WITH ROLLING MEANS WHEN BABY DISENGAGES BOTTLE NIPPLE

BACKGROUND OF THE INVENTION

1. Field of the Invention

The invention relates to a baby bottle holder, and more particularly, to a baby bottle holder that has a tendency to roll the baby bottle from the infant's torso when the infant has moved and disengaged the nipple.

2. Description of the Related Art

Many baby bottle holders have been designed to help relieve a parent or caretaker from having to maintain a baby bottle in an inclined position for a prolonged period during an infant's feeding. These holders can be used in a situation where the parent or caretaker has to temporarily attend to other demands while still meeting the needs of a feeding infant. For example, U.S. Pat. No. 4,895,327 to Malone et al. for "Infant Feeding Aid Apparatus and Method" discloses a feeding aid designed to be placed on the torso of an infant. The device includes two anchor sections to be placed on opposite sides of the torso of the infant during feeding. While this anchoring system may provide for the maintenance of the baby bottle while the infant is feeding, when the infant has finished feeding, the baby bottle remains secured in position on the infant until someone removes the device. A need exists for an apparatus that, when placed on a baby's torso, inclines the bottle to allow an infant to feed from the bottle and then causes the bottle to roll off the infant's torso when the infant disengages the nipple.

SUMMARY OF THE INVENTION

In accordance with the invention, a baby feeding device and bottle holder is provided that has a central body portion for securing a baby bottle thereto and in one embodiment defines a chamber for housing the baby bottle. The central body portion is made of a soft, nontoxic fabric material and is filled with a lightweight resilient fiber material. In one embodiment, a semi-cylindrical trough is located within the central body portion to receive the baby bottle and to define a desired convex exterior central body lower curvature. The chamber has an opening formed in the central body portion for insertion of the baby bottle. The opening also may have about its periphery a ring of elastic material for maintaining the baby bottle in the chamber. The central body portion is releasably attached to a wedge having a rounded bottom. Preferably, the upper surface of the wedge has a channel complementary with the exterior lower central body portion for receiving a lower portion of the central body portion. The wedge inclines the bottle to enable the infant to readily feed from the bottle. In another embodiment, the central body portion and the wedge are an integral piece. When the infant moves and disengages the nipple, the central body portion and wedge have a tendency to roll off the infant's torso.

In a preferred embodiment, the baby bottle holder includes a weight positioned to create a force that urges the central body portion and the wedge to roll off of the infant's torso.

A pair of flaps extend outwardly from the central body portion in a preferred embodiment. These flaps help to stabilize the baby bottle during feeding. Each flap may include a weight and have a raised plastic dot fabric material on the flap bottoms to resist sliding.

In a preferred embodiment, the central body portion forms the head and torso shape of a stuffed animal for entertainment of the child during feeding. The stuffed animal portion can contain the weight used to create a moment to facilitate the roll off of the baby bottle. This stuffed animal portion may further include a sound synthesizer for the infant's amusement.

DETAILED DESCRIPTION OF THE PREFERRED EMBODIMENTS

Figure 1:
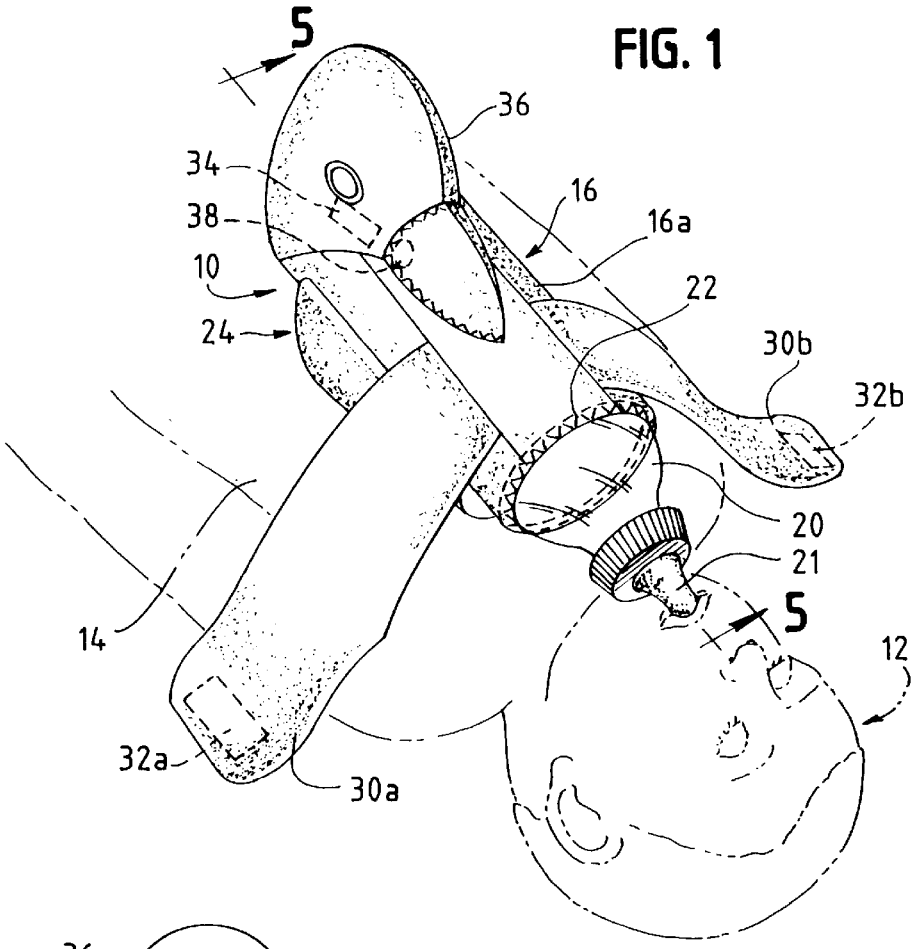
FIG. 1 is a perspective view of a baby bottle holder in accordance with the present invention shown placed on the torso of an infant.
Figure 2:
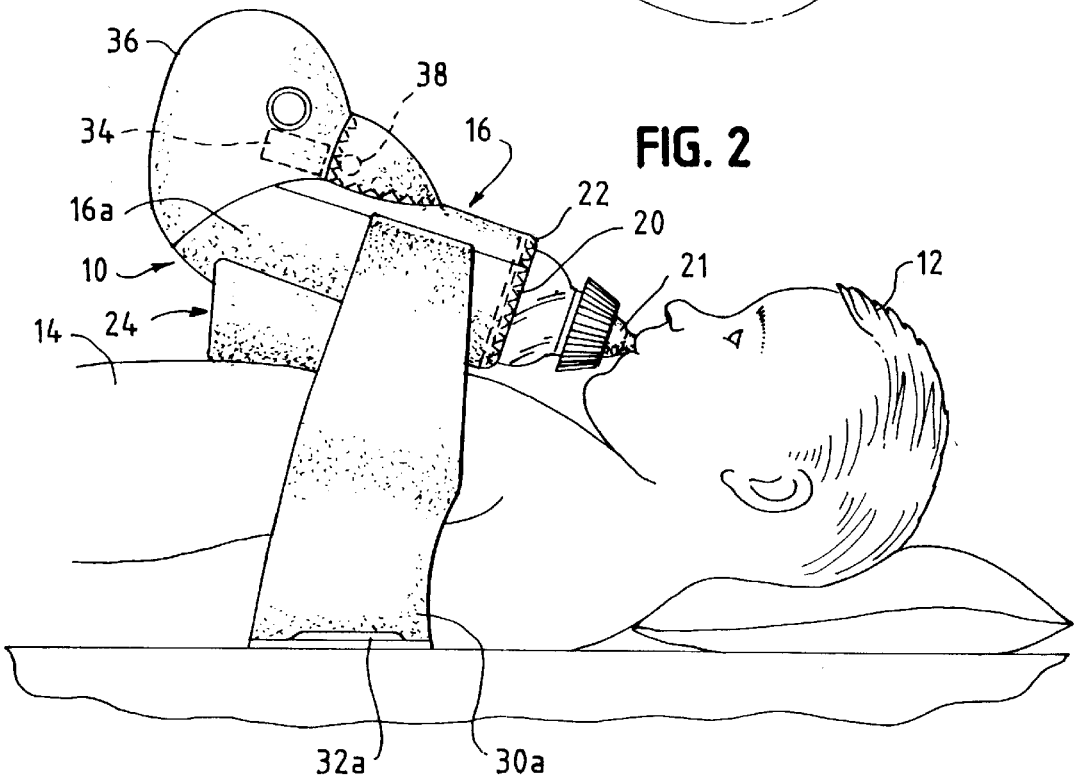
FIG. 2 is a side view of the baby bottle holder of the present invention shown placed on the torso of an infant.

Referring to the FIGURES generally, where like reference numerals represent like parts, and in particular to FIGS. 1 and 2, there is shown a baby bottle holder 10 in accordance with the invention to be used for feeding an infant 12 having a torso 14. Baby bottle holder 10 has been placed on torso 14 of infant 12. Baby bottle holder 10 includes a central body portion 16 having an exterior surface 16*a* made of a soft, nontoxic fabric material and defining an elongated chamber 18, most clearly seen in FIG. 3, for receiving a baby bottle 20 having a nipple 21. Chamber 18 has a central body portion opening for inserting baby bottle 20 therein. Central body portion 16 is filled with a lightweight resilient fiber material 17, in this case garnetted polyester fiberfill available from Airtex Inc. of Cokta, Minn. 55321. Any suitable fill material can be used in accordance with the invention. In the preferred embodiment, central body portion 16 also includes an elastic ring 22 for maintaining baby bottle 20 in chamber 18.

Figure 4:
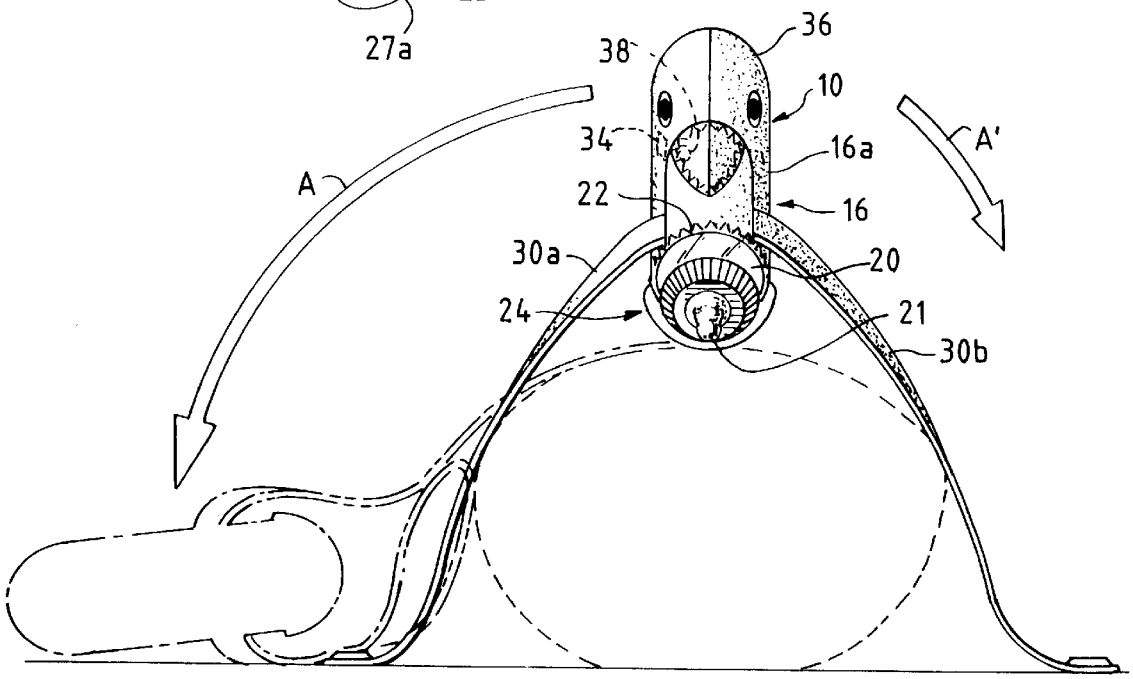
FIG. 4 is a perspective view of the baby bottle holder shown on a phantom schematic torso of an infant and showing in phantom the baby bottle holder after rolling off the infant.
Figure 5:
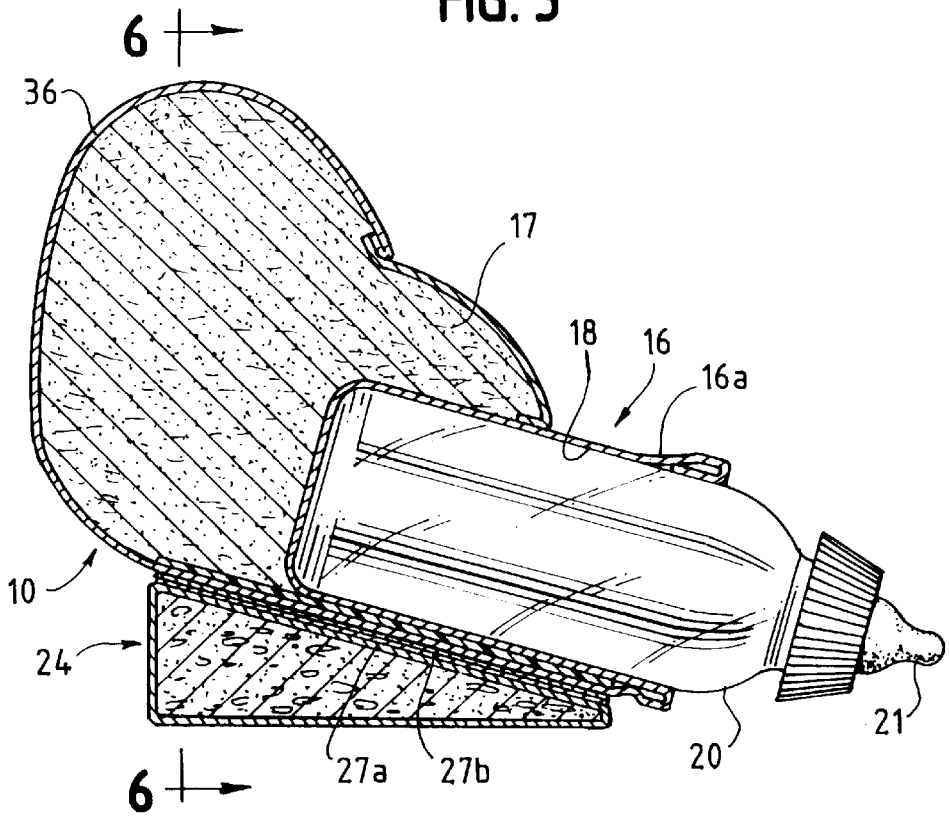
FIG. 5 is a sectional view taken along line 5—5 of FIG. 1.
Figure 6:
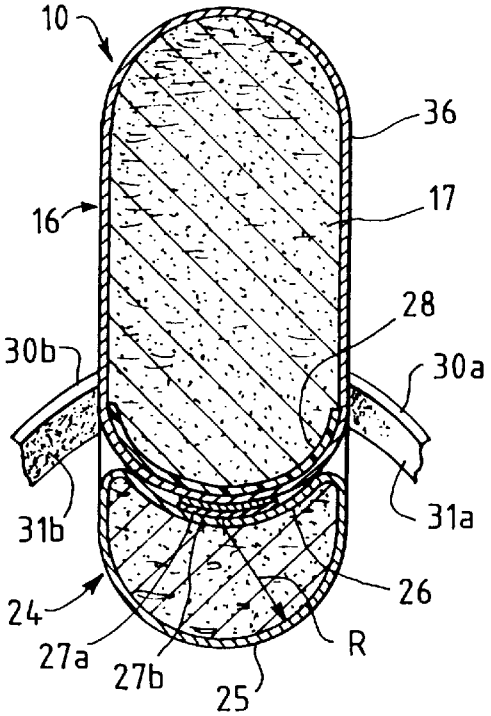
FIG. 6 is a sectional view taken along line 6—6 of FIG. 5.
Figure 7:
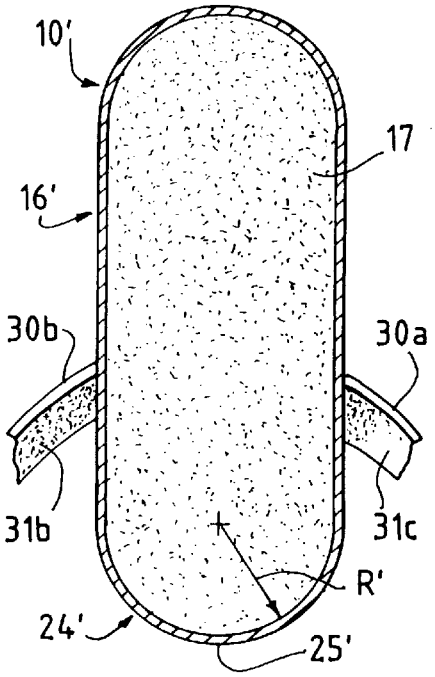
FIG. 7 is a sectional view similar to FIG. 6, but of an alternative embodiment of the baby bottle holder.

As shown in FIG. 5, central body portion 16 rests on a wedge 24 that inclines baby bottle 20 so that infant 12 can readily feed from baby bottle 20. Preferably, wedge 24 inclines baby bottle 20 to an angle sufficient to reduce or eliminate the entry of air into baby bottle 20 through nipple 21. Wedge 24 is placed on torso 14 of infant 12 when infant 12 is feeding. Wedge 24 is filled with a lightweight, resilient material, which in the preferred embodiment is fire-resistant polyester for the comfort of infant 12. Wedge 24 preferably has a weight of about 2.6 ounces. In the alternative embodiment shown in FIGS. 8–10, wedge 24" is made of a suitable plastic material and defines an internal cavity. In the embodiments of FIGS. 6 and 7, wedges 24, 24' have a curved bottom 25, 25', preferably having a radius of curvature R and R' of about 1–2 inches, as illustrated in FIGS. 3–7, for example. Central body portion 16 is separate from wedge 24. Wedge 24 releasably receives central body portion 16 and is joined to central body portion 16 by appropriate temporary securing structure, which in this case is hook and loop fasteners 27*a,b*, commercially available as Velcro®. Alternatively, wedge 24' and central body portion 16' are a single integral piece as shown in FIG. 7, where baby bottle holder 10' includes central body portion 16' filled with resilient fiber material 17, a wedge portion 24' having curved bottom 25' and elongated flaps 30*a,b* extending from opposed sides of body 16'.

Figure 3:
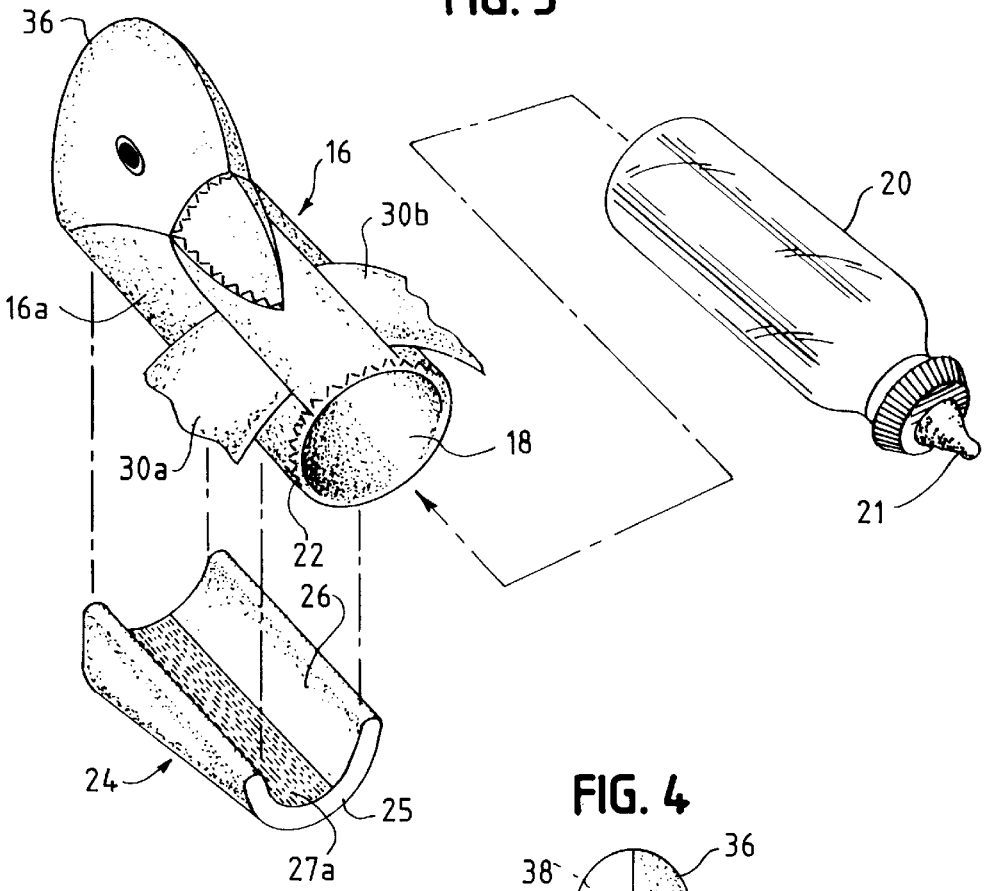
FIG. 3 is an exploded view of the baby bottle holder.

In the preferred embodiment, wedge 24 includes a channel 26 for receiving a lower portion of central body portion 16, as shown in FIGS. 3–4. Because exterior surface 16*a* of central body portion 16 is made of soft fabric and central body portion 16 has lightweight resilient filling 17, central body portion 16 generally conforms to the shape of baby bottle 20 thereby facilitating placement of central body portion 16 in channel 26. Alternatively, as shown in FIG. 6, a semi-cylindrical trough 28 is housed within central body portion 16 and receives baby bottle 20. In this embodiment, central body portion 16 generally conforms to the shape of trough 28. In the embodiment in which wedge 24' is integral with central body portion 16', trough 28 can be eliminated, as shown in FIG. 7.

Figure 8:
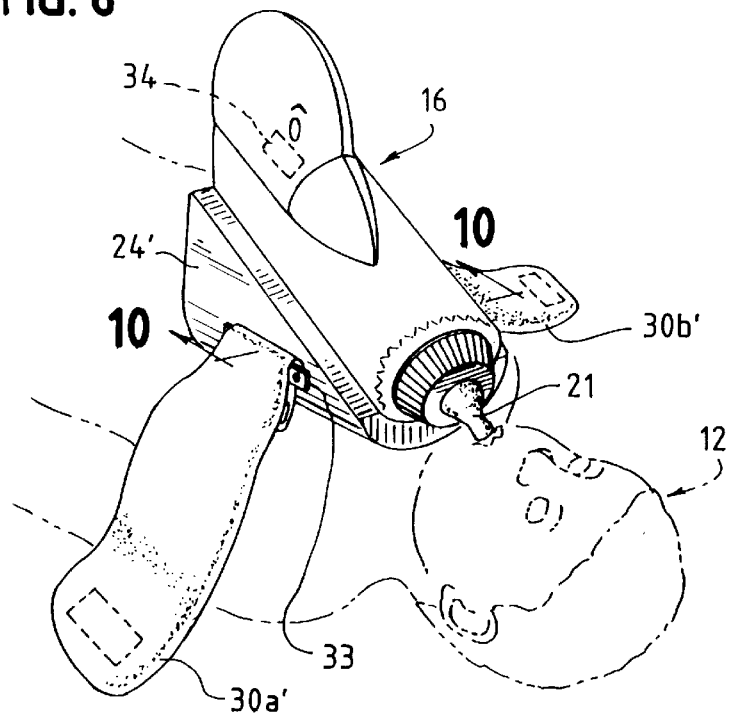
FIG. 8 is a perspective view of an alternative embodiment of the baby bottle holder of the present invention.
Figure 9:
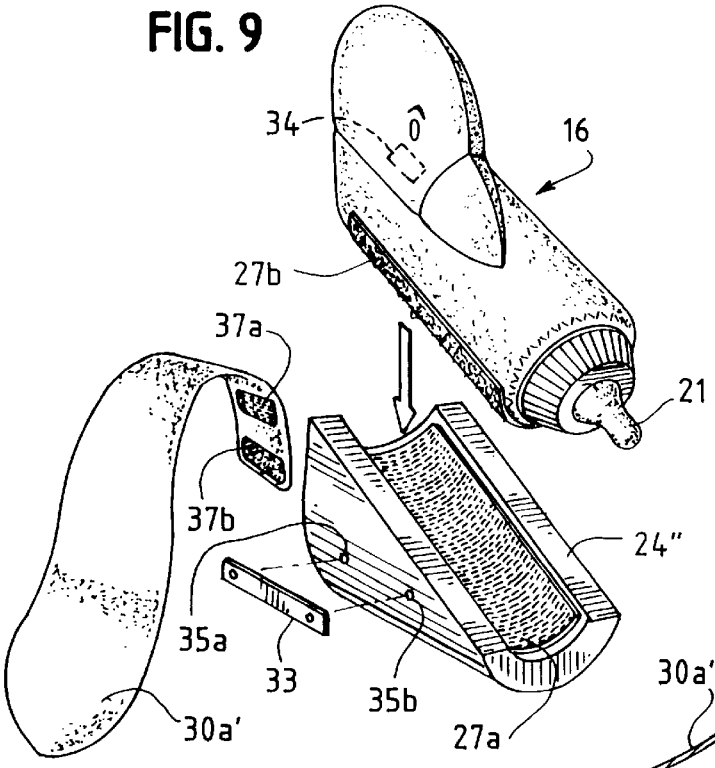
FIG. 9 is an exploded view of the baby bottle holder of FIG. 8.
Figure 10:
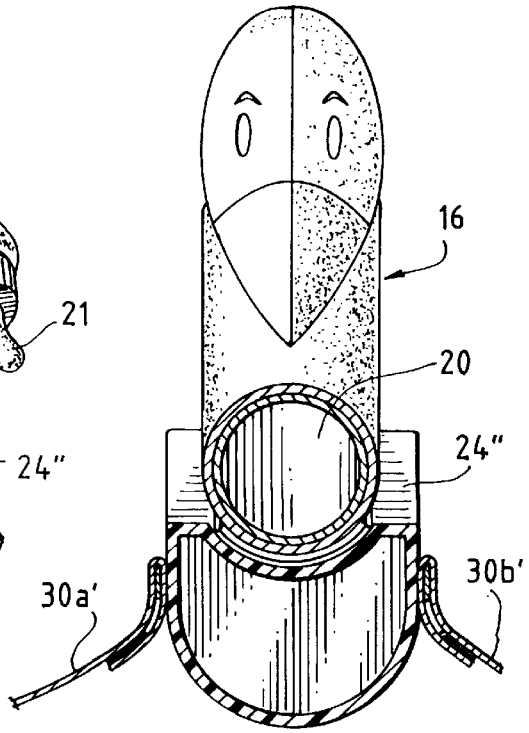
FIG. 10 is a sectional view taken along line 10—10 of FIG. 8.

A pair of elongated flaps 30*a,b* extend outwardly from opposed sides of central body portion 16 and are used to assist positioning of central body portion 16 on torso 14 of infant 12. Alternatively, flaps 30*a'* and 30*b'* are releasably connected to wedge 24" by strap 33 and snaps 35*a,b* as shown in FIGS. 8–10 and are attached to themselves. In this embodiment, flaps 30*a'* and 30*b'* include hook and loop material such as Velcro® portions 37*a,b*. Flaps 30*a,b* help to stabilize central body portion 16 while infant 12 is feeding from baby bottle 20. Flaps 30*a,b* preferably include weights 32*a,b* to stabilize central body portion 16 while infant 12 is feeding. During feeding, flaps 30*a,b* are placed on either side of the torso of infant 12 as shown in FIGS. 1 and 2. The bottom surfaces 31*a,b* of flaps 30*a,b* are preferably made of a raised plastic dot fabric material that resists sliding and helps to maintain central body portion 16 in place while infant 12 is feeding. Such raised plastic dot fabric material is commercially available from Staple Sewing Aids, Corp. of Garfield, N.J. 07026 under the trademark Jiffy Grip.

In the preferred embodiment, a weight 34 is positioned in central body portion 16 and preferably located offset or to one side of and above the center of gravity of the central body portion 16 of device 10 (exclusive of weight 34) so as to create a moment that urges central body portion 16 and wedge 24 to roll off torso 14 of infant 12. Weight 34 is of sufficient mass to cause central body portion 16 and wedge 24 to roll off infant 12 by overcoming the stabilizing effect of flaps 30*a,b* when infant 12 moves and disengages nipple 21. However, weight 34 is light enough that it does not cause central body portion 16 and wedge 24 to roll off infant 12 when infant 12 is feeding from baby bottle 20. In the preferred embodiment, weight 34 is in the range of about 0.5–1.0 ounce, for example about 0.6 ounces.

Central body portion 16 is in the general shape of the torso of an animal and includes a stuffed head portion 36 in the preferred embodiment. Stuffed head portion 36 can house weight 34. Also, to entertain infant 12, stuffed head portion 36 preferably houses a sound synthesizer 38, which can be a waterproof music button No. P-1093-40 that can be obtained from Darice, Inc. of Strongville, Ohio 44136.

In operation, baby bottle 20 is placed in chamber 18 of central body portion 16. Central body portion 16 is attached via fasteners 27*a,b* to wedge 24. Baby bottle holder 10 is placed on torso 14 of infant 12. Flaps 30*a,b* are placed so that each side of infant 12 is draped by one of flaps 30*a,b*, as shown in FIGS. 1–2 and 4. Infant 12 feeds from nipple 21 of baby bottle 20.

When infant 12 has finished feeding and disengages nipple 21, weight 34 causes the now unrestrained baby bottle holder 10 to roll off torso 14 of infant 12 as depicted in FIG. 4 in the direction of arrow A. In the embodiment of the invention without weight 34, bottle holder 10 would have a tendency to roll off in either direction A or A' if holder 10 is subjected to a slight force that initiates movement, such as the baby coughing or moving its torso slightly. Thus, an apparatus has been disclosed that provides for feeding of infant 12 without a parent or caretaker having to hold baby bottle 20 for an extended period of time and providing for automatic removal of baby bottle 20 when infant 12 has finished feeding.

Alternatively, in place of chamber 18, other structure (not shown) may be used to secure a baby bottle to the baby bottle feeding device, such as a strap which could extend from one of flaps 30*a,b* to the other of flaps 30*a,b*. Such a strap could be made of hook and loop material such as Velcro®.

Whereas the present invention has been described with respect to specific embodiments thereof, it will be understood that various changes and modifications will be suggested to one skilled in the art and it is intended that the invention encompass such changes and modifications as fall within the scope of the appended claims.

What is claimed is:

1. A feeding device for placement on a torso of an infant and for holding a baby bottle having a nipple at one end for feeding the infant from the baby bottle, comprising:

a central body portion including means for securing the baby bottle to said central body portion;

means for inclining the bottle on the torso of the infant to facilitate engagement of the nipple by the infant; and means operatively connected to said central body portion for urging said central body portion to roll from the torso of the infant when the infant disengages the nipple of the bottle.

2. The feeding device of claim 1 wherein said urging means comprises a weight operatively connected to said central body portion and positioned with respect thereto to create a moment that urges said central body portion to roll off the infant.

3. The feeding device of claim 1 wherein said means for securing the baby bottle comprises an elongated chamber defined by said central body portion for housing and securing the baby bottle and having a central body portion opening for inserting the baby bottle therein.

4. The feeding device of claim 3 wherein said central body portion opening includes an elastic ring for maintaining the baby bottle within said chamber.

5. The feeding device of claim 3 wherein said central body portion further comprises a portion that extends upwardly from the elongated chamber.

6. The feeding device of claim 1 wherein said inclining means comprises a wedge for receiving said central body portion.

7. The feeding device of claim 6 wherein said urging means comprises a curved wedge bottom for resting on the infant's torso during feeding.

8. The feeding device of claim 6 wherein said wedge and said central body portion are integral.

9. The feeding device of claim 6 further comprising means for assisting the positioning of the central body portion on the infant's torso.

10. The feeding device of claim 9 wherein said assisting means includes a first elongated flap extending outwardly from a first side of said wedge and a second elongated flap extending outwardly from a second side of said wedge opposed to the first side.

11. The feeding device of claim 1 further comprising means for assisting the positioning of the central body portion on the infant's torso.

12. The feeding device of claim 11 wherein said assisting means includes a first elongated flap extending outwardly from a first side of said central body portion and a second elongated flap extending outwardly from a second side of said central body portion opposed to the first side.

13. The feeding device of claim 12 wherein said first flap includes a first weight and said second flap includes a second weight.

14. A feeding device for feeding an infant from a baby bottle to be placed on a torso of an infant to hold a generally cylindrical baby bottle having a nipple at one end thereof, comprising:

a central body portion defining a chamber for housing the baby bottle and having an elastic ring for maintaining the baby bottle within said chamber;

a wedge for releasably receiving said central body portion and facilitating engagement of the nipple by the infant;

a first weighted elongated flap extending outwardly from one side of said central body portion;

a second weighted elongated flap extending outwardly from the other side of said central body portion and in a direction generally opposite said first weighted flap; and a weight operatively associated with said central body portion, positioned to create a force moment that urges said central body portion and said wedge to roll off the infant.

15. A feeding device for placement on a torso of an infant and for holding a baby bottle having a nipple at one end for feeding the infant from the baby bottle, comprising:

a central body portion including means for securing the baby bottle to said central body portion;

means for inclining the bottle on the torso of the infant to facilitate engagement of the nipple by the infant; and means operatively connected to said central body portion for urging said central body portion to roll from the torso of the infant when the infant disengages the nipple of the bottle;

wherein said means for securing the baby bottle comprises an elongated chamber defined by said central body portion for housing and securing the baby bottle and having a central body portion opening for inserting the baby bottle therein;

wherein said central body portion further comprises a portion that extends upwardly from the elongated chamber; and wherein said urging means comprises a weight located in said portion that extends upwardly and positioned in a location offset from the center of gravity of the central body portion to create a force moment that urges said central body portion to roll off the infant.

16. A feeding device for placement on a torso of an infant and for holding a baby bottle having a nipple at one end for feeding the infant from the baby bottle, comprising:

a central body portion including means for securing the baby bottle to said central body portion;

means for inclining the bottle on the torso of the infant to facilitate engagement of the nipple by the infant; and means operatively connected to said central body portion for urging said central body portion to roll from the torso of the infant when the infant disengages the nipple of the bottle;

wherein said inclining means comprises a wedge for receiving said central body portion;

wherein said urging means comprises a curved wedge bottom for resting on the infant's torso during feeding; and wherein said wedge further comprises a channel opposite said curved bottom, for receiving at least a portion of said central body portion.

17. A feeding device for placement on a torso of an infant and for holding a baby bottle having a nipple at one end for feeding the infant from the baby bottle, comprising:

a central body portion including means for securing the baby bottle to said central body portion;

means for inclining the bottle on the torso of the infant to facilitate engagement of the nipple by the infant, wherein said inclining means comprises a wedge for receiving said central body portion;

means operatively connected to said central body portion for urging said central body portion to roll from the torso of the infant when the infant disengages the nipple of the bottle; and means for releasably attaching said central body portion to said wedge.

* * * * *